United States Patent [19]

Chow

[11] Patent Number: 4,509,633

[45] Date of Patent: Apr. 9, 1985

[54] ELECTRONIC COIN VALIDATOR WITH IMPROVED DIAMETER SENSING APPARATUS

[75] Inventor: Edmund E. Chow, Lilburn, Ga.

[73] Assignee: Reed Industries, Inc., Stone Mountain, Ga.

[21] Appl. No.: 525,997

[22] Filed: Aug. 24, 1983

[51] Int. Cl.[3] ..... G07F 3/02

[52] U.S. Cl. ..... 194/100 A; 73/163

[58] Field of Search ..... 133/3 R, 8 R; 194/100 A, 102; 209/571, 576; 73/163

[56] References Cited

U.S. PATENT DOCUMENTS

| | | | |
|---|---|---|---|
| 3,653,481 | 4/1972 | Boxall | 194/100 A |
| 3,797,307 | 3/1974 | Johnston | 73/163 |
| 3,918,564 | 11/1975 | Heiman | 194/100 A |
| 3,918,565 | 11/1975 | Fougere | 194/100 A |
| 4,234,071 | 11/1980 | Le-Hong | 194/100 A |
| 4,249,648 | 2/1981 | Meyer | 194/101 |
| 4,267,916 | 5/1981 | Black | 194/102 |

*Primary Examiner*—Stanley H. Tollberg
*Attorney, Agent, or Firm*—Jones & Askew

[57] ABSTRACT

An improved electronic coin validator responsive to detect a plurality of different denominations of valid coins. The validator is constructed around a microcomputer (60). A single coil (30) in the tank circuit of an oscillator is used to determined content. The output of the oscillator is rectified (111, 112) and filtered (115, 116) to give an output signal (120) having a magnitude proportional to the envelope of the oscillator output. An improved diameter detection arrangement using only two LED/optodetector pairs (32, 132, 35, 135) is used to determined diameter by determining the actual average velocity of the coin as it travels down the runway by the sensors and thus to calculate a chord length using the calculated average velocity and a time period (T3) measured as the coin passed the sensors. A plurality of vend prices may be set by the state of a plurality of dip switches (69) and the microcomputer also provides control signals (150, 156) to a laundry machine.

7 Claims, 14 Drawing Figures

MATCH LINE 88
89
75
WR
RD
OE
R/W
62
8748
DATA BUS
DATA
RAM
ADDRESS
TO
TI
INT
PI0
PI1
PI2
PI3
PI4
PI5
PI6
PI7
ALE
P27
P26
P25
P24
P23
P22
P21
P20
76
77
78
60
90
+Vu
146
VEND SOLENOID
142
145
147
DISPLAY
65
148
158
LATCHES
STR
D1
D2
D3
D4
150
151
152
155
DECODER AND OPTO-COUPLERS
156
66
67
FROM WASHER SWITCHES

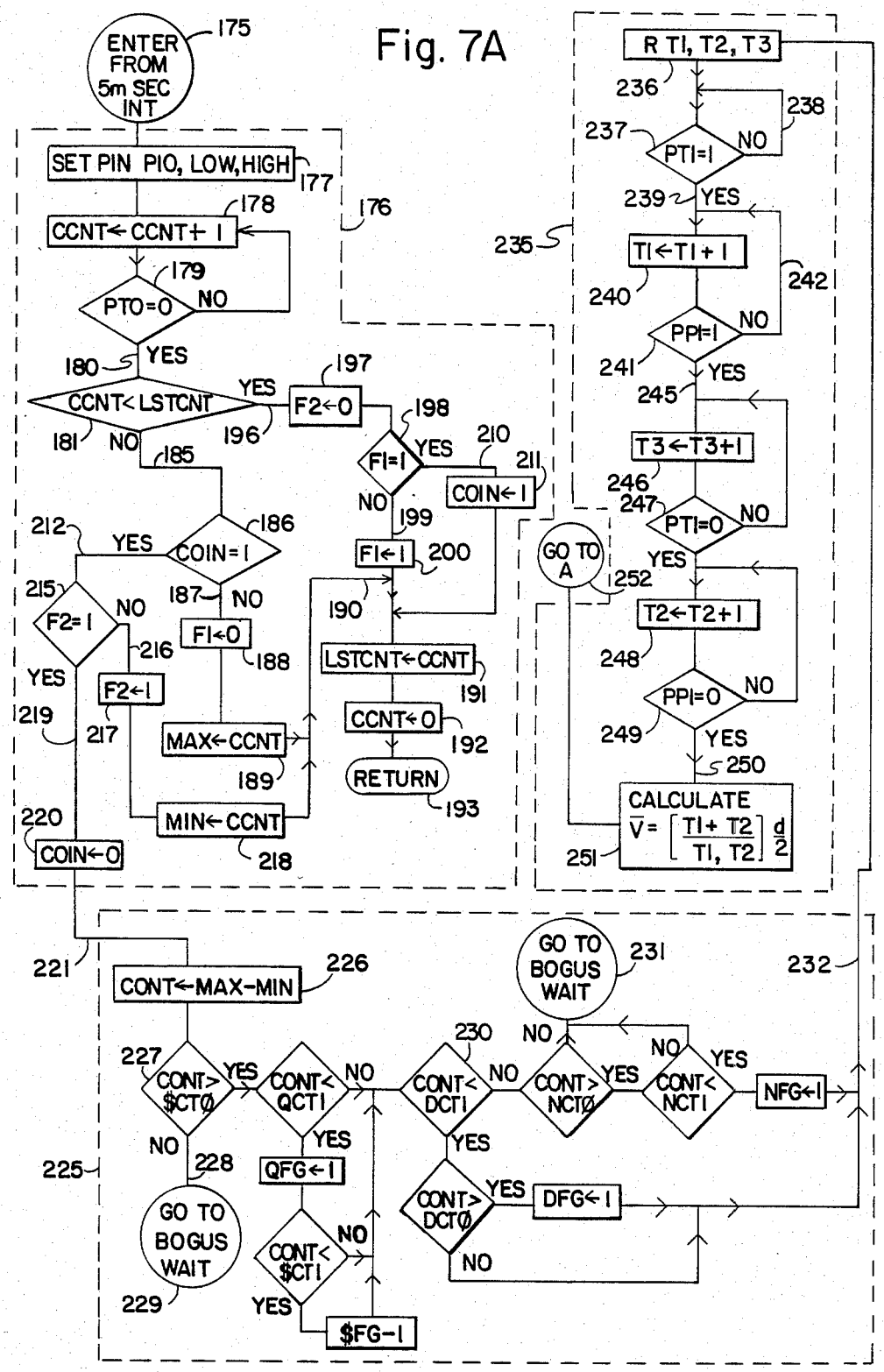
Fig. 7A
ENTER FROM 5m SEC INT
175
SET PIN PIO, LOW, HIGH
177
176
CCNT←CCNT+1
178
PTO=0
179
NO
YES
180
CCNT<LSTCNT
YES
NO
181
196
F2←0
197
FI=1
198
YES
NO
199
210
COIN←1
211
FI←1
200
190
LSTCNT←CCNT
191
CCNT←0
192
RETURN
193
185
COIN=1
186
YES
NO
187
212
F2=1
215
NO
YES
216
F2←1
217
219
FI←0
188
MAX←CCNT
189
MIN←CCNT
218
COIN←0
220
R TI, T2, T3
236
237
PTI=1
NO
238
239
YES
235
TI←TI+1
240
242
PPI=1
NO
241
YES
245
T3←T3+1
246
247
PTI=0
NO
YES
GO TO A
252
T2←T2+1
248
PPI=0
NO
249
YES
250
CALCULATE
V̄= [TI+T2 / TI, T2] d/2
251
221
CONT←MAX-MIN
226
GO TO BOGUS WAIT
231
232
227
CONT> $CTØ
YES
NO
CONT< QCTI
NO
YES
QFG←1
CONT< $CTI
NO
YES
$FG-1
225
228
GO TO BOGUS WAIT
229
230
CONT< DCTI
NO
YES
CONT> DCTØ
YES
NO
DFG←1
CONT> NCTØ
NO
YES
CONT< NCTI
NO
YES
NFG←1

A
252'
CALCULATE DE=V̄ X T3 + d
255

260
DE<DØ
261
YES
272
262
GO TO BOGUS WAIT
265
NO
NO
166
270
271
256
DE<DI
YES
DFG=1
VAL← 0.10
275
276
267
NO
277
268
DE<NØ
YES
GO TO BOGUS WAIT
257
NO
NO
DE<NI
YES
NFG=1
YES
VAL← 0.05
258
QUARTER TEST
259
DOLLAR TEST
278
SOL← 1
286
TOT≥S RUN
NO
287
RETURN
280
YES
288
RETURN
282
SOL← 0
ENTER FROM INTERRUPT
GO TO OPERATING ROUTINE
TOT← TOT + VAL
281
290
285

ELECTRONIC COIN VALIDATOR WITH IMPROVED DIAMETER SENSING APPARATUS

TECHNICAL FIELD

The present invention is in the field of electronic coin validators used in vending machines and the like and, in particular, discloses an electronic coin validator with an improved diameter sensing apparatus using only two coin sensors disposed along a coin's path of travel through the validitor which ascertains the coin's diameter by calculating the actual average velocity of the coin as it passes the sensors.

BACKGROUND OF THE INVENTION

Coin operated machinery for vending goods or services in response to insertion of predetermined amounts of coin money are in widespread use both in the United States and throughout the world. Since one of the principal objects of constructing these machines is that they may be operated while unattended by the owner, the unfortunate, but inevitable, result has been that a large number of people attempt to cheat coin operated machines. Among the common forms of cheating, or attempting to cheat, coin operated machines are the use of slugs and the technique of "stringing".

The use of slugs is based on use of a non-coin piece of metal of a size identical to, or substantially similar to, the size of a valid coin. It is inserted into the machine in an attempt to operate it. Stringing is a cheating method whereby a piece of string is wrapped around the outer diameter of a coin and used to lower, and then attempt to remove, a coin from a vending machine so that the mechanism responds to insertion of the coin but the coin does not drop into the coin box.

Since the invention of the transistor, more and more vending machines are using electronic apparatus in coin validators. Among the advantages are greater reliability, and the fact that electronic coin validators may be designed to be much more immune to the use of slugs than many mechanical validators. For example, slide type mechanical coin chutes are virtually unable to detect slugs if the diameter and thickness of the slug is made the same as that of a valid coin. Prior art mechanical coin validators using falling coins had various arrangements for bouncing the deposited coin at the end of a fall down a runway because the densities of materials commonly used for slugs and valid coins tended to differ. Thus, the weight (as well as, in some cases, the elasticity) of a slug was different from that of a valid coin of the same dimensions. Most of these arrangements were limited to validators for accepting only one denomination of coin.

Electronic validators have provided various arrangements for detecting not only the diameter of coins but also electronic sensing means for detecting the metallic content of the coin as it traverses a predefined path along a runway through the validator.

Additionally, the use of modern electronics in coin validators has allowed arrangements where a single coin path for accepting all coins may be defined, but wherein the validator can detect the presence of a plurality of different denominations of coins having different metal content and different diameters.

As the construction of electronic validators for accepting coins of differing denominations has expanded, the arrangements for detecting various valid diameters have become more complex. For example, U.S. Pat.

No. 4,249,648 to Myers discloses an electronic microprocessor driven arrangement wherein an optical lens and a light sensing array of elements are mounted next to a transparent portion of a chute carrying the coin, defining the predetermined path it travels through the validator.

As the coin enters the transparent portion, it becomes disposed between the light sensing array and a source of light. Periodically, at a high clock rate, contents of the shift register elements connected to the light sensing array (all of which is manufactured as a single unit) are shifted out and analyzed. When the trailing edge of a coin is detected by noting that the shift register is beginning to show a dark to light transition at the end corresponding to the physical front end of the transparent section, the contents of this scan of the shift register are analyzed to determined the diameter of the coin by the number of array elements which were darkened. Thus, a measure of the chord of the circle defined by the perimeter of the coin is made as it passes across the array.

U.S. Pat. No. 4,267,916 to Black et al. shows an arrangement using an array of light emitting diodes (LEDs) to measure chord length of a coin passing by the array. The apparatus detects coincidence between the covering of a particular LED of the array and a plurality of other LEDs in the array to determine a chord length. Circuitry requires a plurality of flip-flops and gates to detect the coincidence.

U.S. Pat. No. 3,653,481 to Boxall et al. shows an arrangement using four monostable multivibrators (one shots) per denomination of coin to detect coin diameters. The device disclosed in the Boxall patent uses a pair of one shots to perform each of two tests. The first test is for the length of time between the crossing of a first light emitting diode and the crossing of a second light emitting diode. The second test is directed to the time taken to initially cover and then uncover the second light-emitting diode. Since each one shot pair is set for a maximum and minimum acceptable value for a coin of a particular denomination, four one shots are required per denomination. A range of variations of the velocity of the coin as it travels down the path across the LED sensors must be "built in" to the timing periods of the one shots, so that variations in coin velocity do not adversely affect the device's accuracy. In essence, the Boxall apparatus requires a virtual constant velocity of coins of each denomination for it to operate properly. This requirement can lead to limitations on the angle at which the path may be disposed with respect to the local gravitational field for the device to work.

Since it is known in the art to use the powerful tool of microprocessors in electronic coin validators (see for example the Myer '648 patent referred to above), there is a need in the art to provide an improved diameter detecting apparatus which will reduce the number of components, external to the microprocessor, required to properly detect diameter, and which will be less sensitive to variations in coin velocity as it travels down the runway than apparatus such as that shown in Boxall.

SUMMARY OF THE INVENTION

The present invention is an improvement in the art of electronic coin validators designed to overcome some of the limitations of the prior art. In the exemplary arrangements described above, insensitivity to variations in coin velocity can be achieved at the expense of rather complex arrangements for physically measuring coin diameter (through actual chord measurement) by using a relatively large array of light sensing devices and relatively cumbersome coincidence detection circuitry. While the arrangement shown in Myer takes advantage of the speed of the microprocessor to rapidly empty and analyze contents of a shift register connected to the light sensing array, arrays of this type are much more expensive than a few LEDs and optical detectors.

Briefly characterized, the improvement of the present invention is one which determines the diameter of a coin passing down a predetermined path (also through actual chord measurement) using only two electronic coin sensing devices (preferably pairs of light emitting diodes and optical detectors). The present invention accomplishes this simplification, and thus reduction in cost, by measuring and storing predetermined time periods between events defined by edges of the coin passing over the electronic coin sensors. These measured time periods are used to determine the average velocity of the coin as it actually passes the sensors. This average velocity, together with one or more of the measured and stored periods of time, can be used to calculate the length of the chord of the coin which passed by the sensors.

Thus, the present invention is rendered (within limits) insensitive to the velocity of the coin as it passes the diameter sensing arrangement. Thus, coin validators embodying the present invention may be mounted at various angles with respect to the horizontal, with resulting variations in the velocity at which the coin travels down the runway of the validator, without adversely affecting the accuracy of the diameter detecting apparatus. All of this can be accomplished without the use of a large array of sensors and complicated coincidence detection circuitry external to a microprocessor.

From the foregoing, it will be appreciated that this arrangement provides a component of an electronic coin validator which can detect a variety of valid coin denominations. When combined with the content sensing apparatus of the preferred embodiment, a wide variety of coin denominations can be accepted by a validator built according to the present invention.

Thus, it is an object of the present invention to provide an improved diameter determining apparatus which requires a minimal number of coin sensors, but which is usable to determine a variety of valid coin diameters.

It is a further object of the present invention to provide electronic diameter testing apparatus for a coin validator which operates properly irrespective of the velocity at which the coin traverses the coin sensors.

It is a further object of the present invention to provide an improved coin validator as recited above which also includes an improved content detection arrangement requiring only a single detecting coil to accurately determine the contents and the diameter of any coin deposited into the validator.

It is a further object of the present invention to provide an improved validator as recited above which is particularly insensitive to variations in ambient temperature and which is particularly useful in laundry machinery.

It is a further object of the present invention to provide an improved validator as recited above which also takes advantage of the capabilities of a microprocessor used in constructing embodiments to further control the coin operated machinery in which it is used.

That the present invention accomplishes these objects, and fulfills other needs which were present in the art of coin validators, it will be appreciated from the detailed description of the preferred embodiment to follow.

BRIEF DESCRIPTION OF THE DRAWINGS

FIG. 1, comprising

DETAILED DESCRIPTION OF THE PREFERRED EMBODIMENT

Figure 1A:
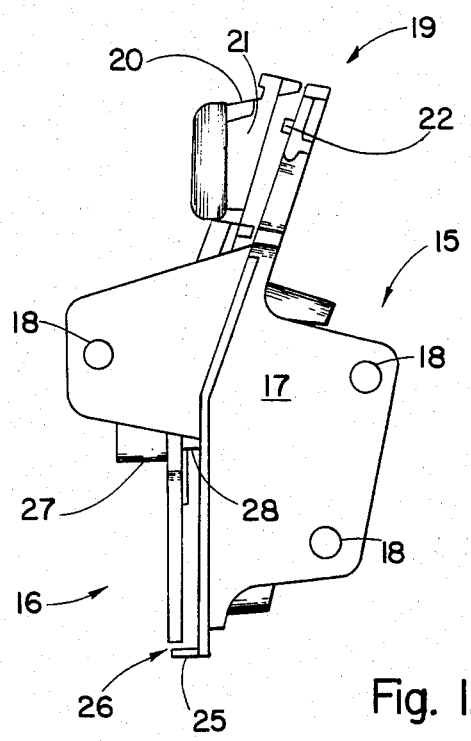
FIGS. 1A–1C, is a pictorial view of the preferred embodiment of a validator built according to the present invention.

Turning now to the drawing figures in which like numerals represent like elements, the preferred embodiment of the present invention will be described. It should first be noted that, as used herein, the term "coin" is used to mean any token which is inserted into the validator in an attempt to operate it. The term includes valid coins, with which the machine is designed to operate, as well as coins minted by countries other than those for which the preferred embodiment is designed to operate, and slugs and other devices designed to cheat the machine. The term "bogus coin" is used to define any coin which is not a valid coin as defined by the preferred embodiment.

Turning first to FIG. 1A front view of the preferred embodiment is shown. The housing for the validator of the present invention is composed of a right side half 15 and a left side half 16. Attached to right side half 15 is a front plate 17 having a plurality of holes 18 drilled therethrough. These holes carry bolts used for attaching the validator of the front plate of a housing for the device (not shown).

At the top of the preferred embodiment is a coin accepting opening 19 which includes a guide wall 20 and a back wall 21. As will be familiar to those skilled in the art, guide wall 20 is parallel to a slot through a front plate in the housing (not shown) which accepts the coins. If the coins are introduced with a high velocity, they will strike back plate 21 and have to fall sideways to roll through tilted slot 22 which forms the beginning of the predetermined path which the coins travel through the validator.

Near the bottom is a lip 25 forming a portion of the coin path at coin return outlet 26. As will be apparent from the explanation below, a coin which is detected to be a bogus coin will exit this path when the preferred embodiment is in use. A sleeve 27 is journaled around a rod 28 which is loaded, via a spring (not shown), to urge side walls 15 and 16 together. Apparatus (not shown) is provided in a conventional manner for forcing side walls 15 and 16 apart in order to unjam a coin which becomes jammed in the interior of the validator.

Figure 1B:
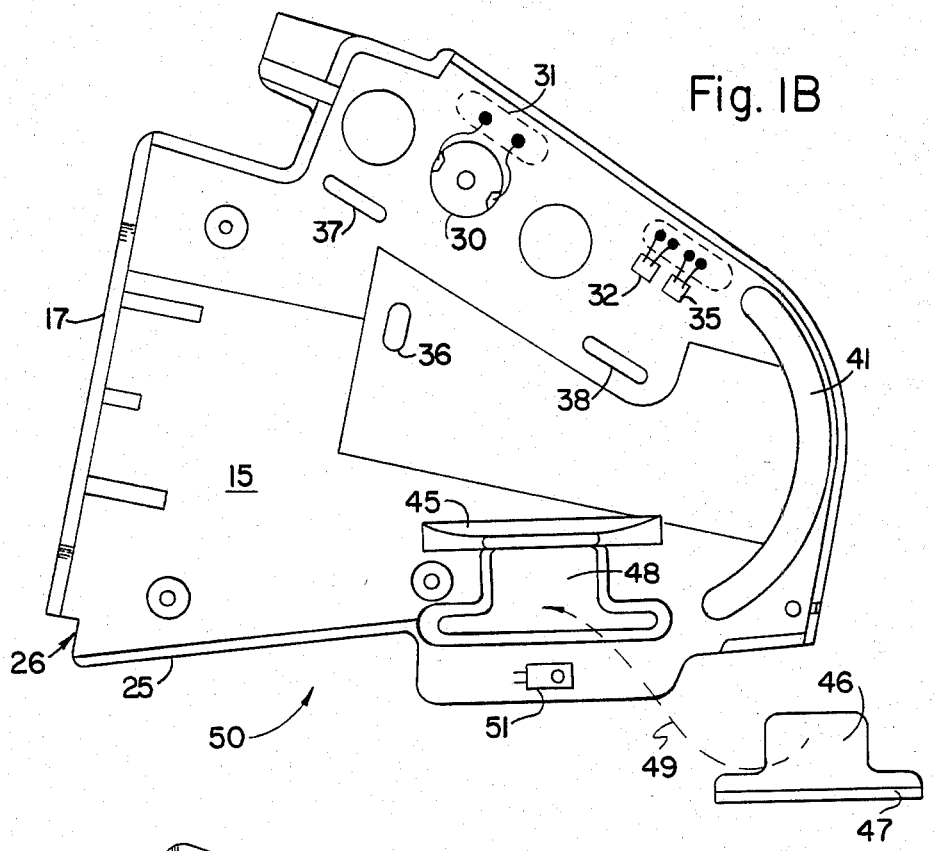
Figure 1C:
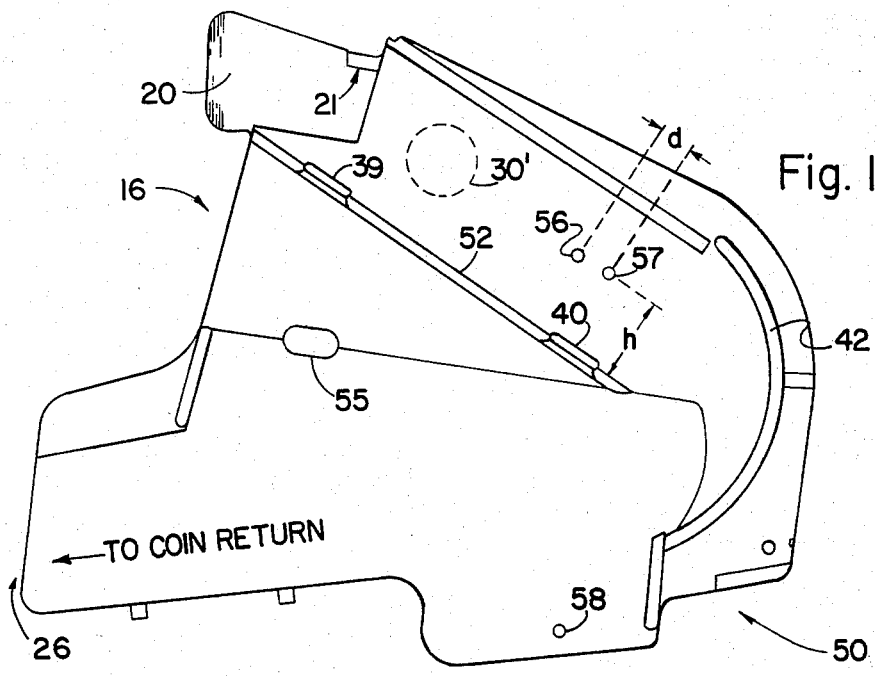

FIGS. 1B and 1C show the right side (as that term was used in connection with FIG. 1A) of each of sides 15 and 16. Thus, FIG. 1B shows the exterior of right side half 15, and FIG. 1C shows the interior of left half side 16. In FIG. 1B, physical placement of some of the electronic devices used in the preferred embodiment is shown. Coil 30 is shown disposed on right side half 15. A pair of terminals 31 connect to a portion of a cable (not shown) used to link the coil to the other electronic circuitry of the preferred embodiment. A pair of optical sensors, 32 and 35, are placed over a pair of small openings (not shown) in side wall 15. An additional hole 36 is shown through which rod 28 passes.

A pair of slots 37 and 38 are provided into which tabs 39 and 40 (FIG. 1C) are placed when the apparatus is assembled. An elongated curved slot 41, into which a similarly shaped tab 42 (FIG. 1C) is fit, is also provided. An elongated platform 45 extends outward from side wall 15 for holding a coin accept solenoid (not shown). Attached to the coin accept solenoid is a removable portion 46 carrying a lip 47 at the bottom which forms a part of the coin path when inserted through opening 48 (as shown by dashed line 49) when the solenoid is not activated. Removable portion 46 is urged into the interior of the validator by spring (not shown) in the absence of a signal being applied to the coin accept solenoid. This assures, in a conventional manner, that lip 47 forms a part of the predefined path of the coin toward coin return opening 26 except when a signal is applied to the coin accept solenoid removing lip 47 from the path allowing a coin to drop through a bottom opening shown at 50 in FIG. 1B.

Disposed between side wall opening 48 and coin box opening 50 is another photodetector 51 which is used to detect a coin passing out of the validator into the coin box. This arrangement assures that a coin is not credited to the total, as described hereinbelow, until it has actually fallen through coin box opening 50 into the coin box. This is designed to prevent persons from successfully stringing coins.

FIG. 1C shows the interior of left side wall 16. Thus it will be appreciated that side wall 15 shown in FIG. 1B would be placed directly over side wall 16 as it is shown in FIG. 1C, when the device is assembled.

A rib 52 defining part of the runway is formed as a part of the same structure as tabs 39 and 40. At the point where rib 52 terminates, curved tab 42 defines the runway. An interior opening 55 is part of the path through which rod 28 is placed. Above rib 52 are a pair of openings 56 and 57, behind which are placed a pair of light emitting diodes. The distance between openings 56 and 57 is shown as d, and defines a predetermined distance between the light emitting diodes. As is shown by dimension h, in the preferred embodiment, the LEDs are spaced a predetermined height above the path of the coin on the runway.

An opening 58, near coin box exit 50, has a light emitting diode for activating optical detector 51 (FIG. 1B) to detect the drop of a coin into the coin box. A projection of coil 30 onto the path of the coin above rib 52 is shown in phantom as 30' in FIG. 1C. Thus it will be appreciated that in the preferred embodiment the content sensing apparatus connected to coil 30 first makes the contents test prior to diameter testing which is accomplished in connection with the light emitting diodes (not shown) behind holes 56 and 57. As will become apparent from the description to follow, it is also the passing of the coin by position 30' that is used to detect the presence of the coin within the validator.

Figure 2:
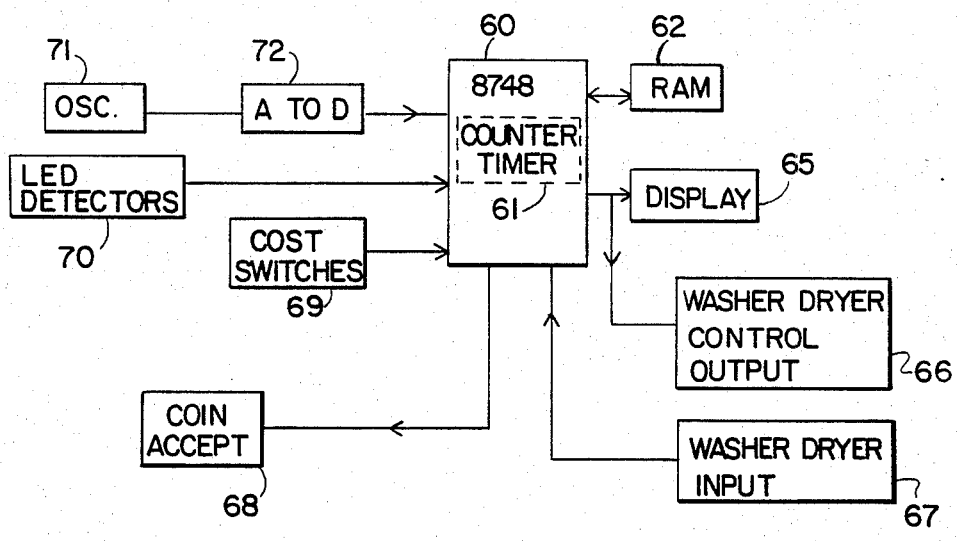
FIG. 2 is a block diagram of the electronic circuitry of the preferred embodiment FIG. 3 consisting of FIGS. 3A and 3B connected by a match line, is a schematic diagram of the preferred embodiment of the present invention.

Turning next to FIG. 2, a block diagram of the electronic circuitry of the preferred embodiment is shown. The preferred embodiment is constructed around a one chip microcomputer shown as 60. In the preferred embodiment, a type 8748, currently manufactured by Intel Corporation, has been used. It will be appreciated by those skilled in the art that, for mass production purposes, it would be preferable to change the 8748 (which contains a user programmable erasable EPROM) to a functionally identical type 8048 having a mask programmed ROM.

As shown in phantom at 61, a counter timer is provided within one chip microcomputer 60. This counter timer comprises a portion of the timing means described hereinbelow.

A random access memory 62 is connected to microcomputer 60 for storing data during operation of the validator.

Also connected to microcomputer 60 is a display 65. A pair of blocks shown as 66 and 67 are interconnections to washer/dryer control outputs and an input from the washer or dryer. As noted above, the environment for which the present invention was specifically designed is that of use in laundry machines. However, the present invention will be useful in many other applications of electronic coin validators.

A coin accept solenoid 68 is controlled by an output of microcomputer 60. A set of dual-in-line switches, shown as cost switches 69, are provided to define the amount of money which must be deposited into the validator in order to activate the apparatus which it controls.

A plurality of LED detectors, which include the optical sensors and light emitting diodes described above, is shown as 70 in FIG. 2. As will be appreciated from the following description, LED detectors 70, microcomputer 60, and RAM 62 comprise the apparatus used to effect the improved diameter measuring apparatus in the preferred embodiment.

Content measuring apparatus includes oscillator 71 which is attached to analog to digital (A to D) converter 72, the output of which is provided to microcomputer 60. Microcomputer 60 writes data into RAM 62 and subsequently reads it out of the RAM, as needed.

Display 65 is not described in detail herein. The display includes a plurality of seven segment display sections which, in the preferred embodiment, are used to display total value of coinage deposited into the validator, time remaining in a dryer cycle, and a particular stage of a wash cycle in which the machine controlled by the validator is operating. Microcomputer 60 provides BCD outputs to display 65 which are latched and multiplexed in a conventional manner.

Microcomputer 60 responds to the outputs from LED detectors 70 to control counter timer 61 in order to measure diameter of coins in the coin path as will be described in detail hereinbelow. Also, it should be understood that the output of oscillator 71 is rectified and the magnitude of this rectified signal is converted to a digital signal by A to D converter 72. Microcomputer 60 detects changes in the digitized output of this magnitude signal to measure coin content.

Figure 3A:
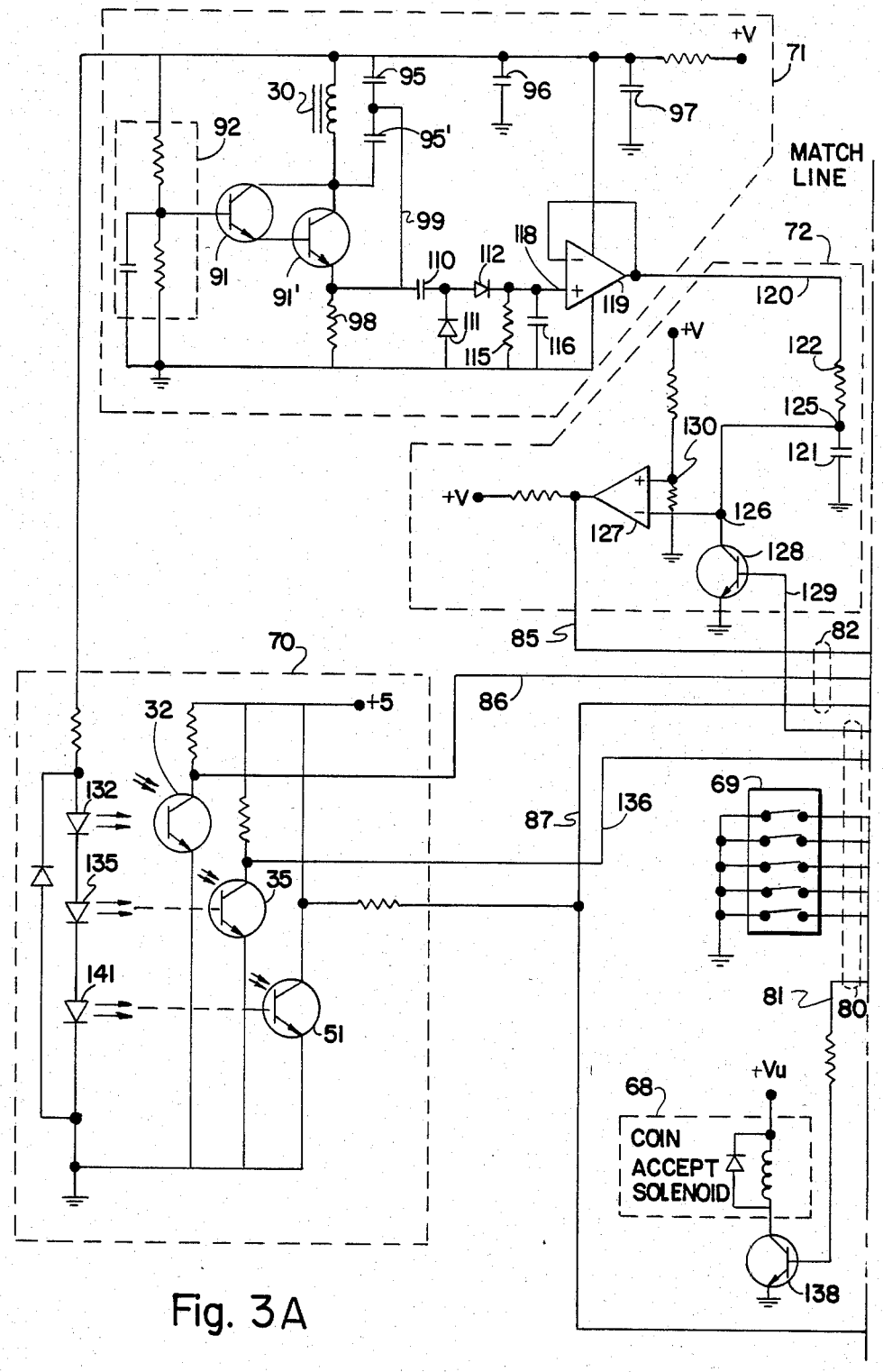
Figure 3B:
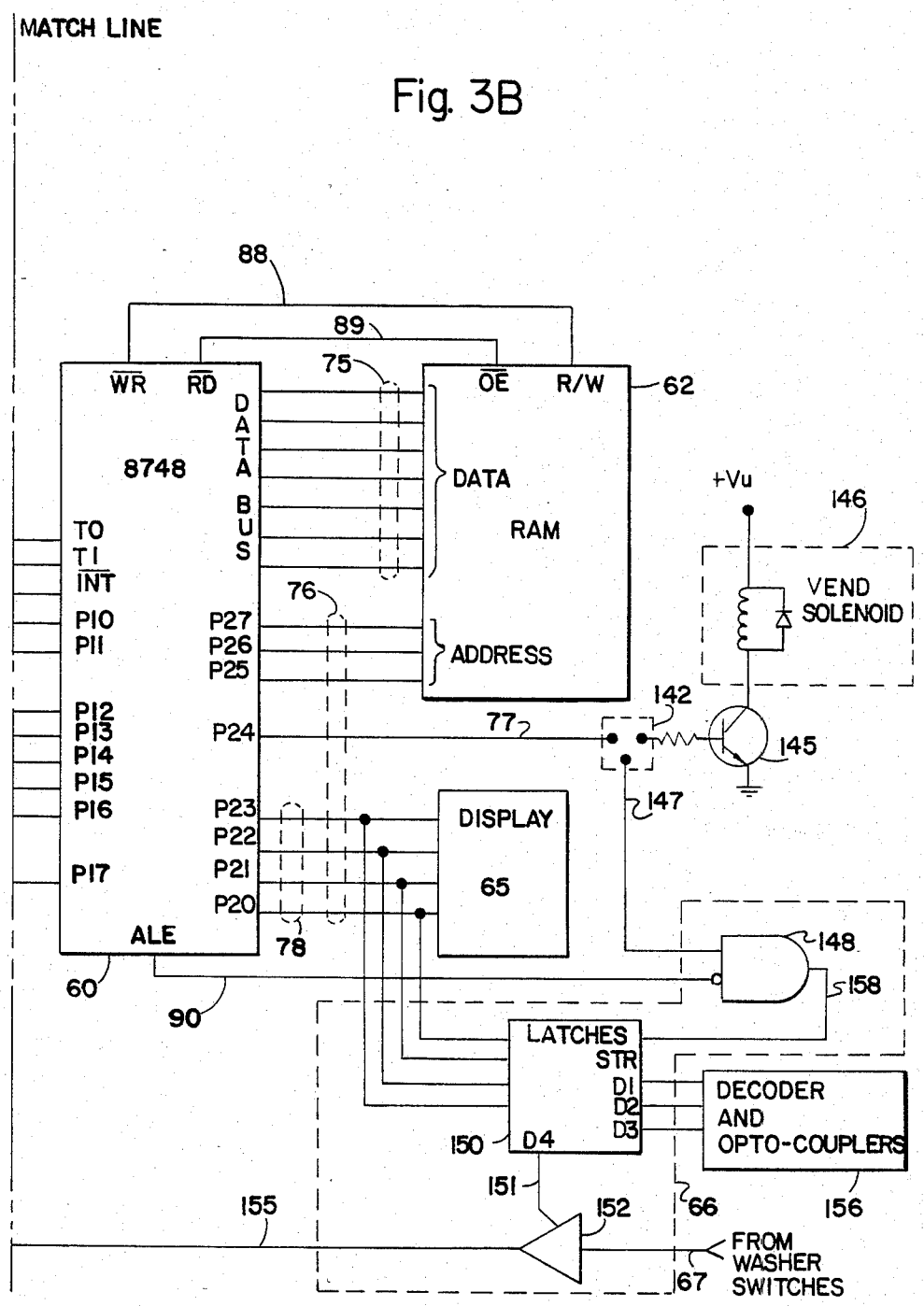

Turning next to FIG. 3, a detailed schematic diagram of the preferred embodiment is shown. FIG. 3 consists of FIGS. 3A and 3B, joined by a match line. Individual elements corresponding to blocks shown on FIG. 2 are referenced with identical numerals, and apparatus composed of a plurality of components which correspond to one of the blocks shown on FIG. 2 is surrounded by a dashed line referenced with the same number as in FIG. 2. For example, the circuitry in the upper lefthand corner of FIG. 3 forms oscillator 71 of FIG. 2, and thus is surrounded by dashed line referenced as 71.

The input/output lines of the type 8748 microcomputer 60 are labeled in FIG. 3 with the designations used by the manufacturer, which will be familiar to those of ordinary skill in the art. The only exception is that data bus 75 is simply labeled as the data bus without designating individual lines. Data bus 75 is a bi-directional bus connecting the data input/output ports of RAM 62 to microcomputer 60. The collection of lines shown as 76 connected to microcomputer 60 form the eight bit port 2 of the 8748. The lines are individually numbered P20–P27. Lines P25–P27 are connected to the address inputs of RAM 62. Output P24 is connected to line 77, the significance of which will be discussed in detail hereinbelow. Lines P20–P23 form a subset 78 of bus 76 which is connected to both display 65 and washer/dryer control output 66. As will be appreciated by those skilled in the art, bus 76 is connected to a quasi bidirectional port of type 8748 microcomputer. As used in the preferred embodiment shown in FIG. 3, port 2, connected to bus 76, is used as a write only port.

Port 1 of the 8748, which is connected to bus 80, is also a quasi bidirectional port. In the preferred embodiment, all of port 1 is used as a read only port with the exception of line 81 which drives coin accept solenoid 68. A connection of three lines shown as 82 is provided to the two testable inputs, lines 85 and 86, and the negated interrupt, which is connected to line 87. As is known to those skilled in the art, the T0 and T1 inputs are testable inputs which may be tested by specified conditional jump instructions of the instruction set of the 8748. Additionally, input T1 tied to line 86 can be used to control counter timer 61.

The negated write and read lines 88 and 89, respectively, are connected to the read/write and output enable lines of RAM 62 in a conventional manner.

The address latch enable (ALE) output of the 8748 is connected to line 90 and is used to control the washer or dryer to which the preferred embodiment is connected, in a manner which will be explained hereinbelow. Any additional details concerning the characterstics of the input and output lines of the 8748 are widely available to the public in publications of the manufacturer, the Intel Corporation. User's manuals for the MCS 48 system, of which the 8748 is a member, are well known to those skilled in the art.

The circuitry of the preferred embodiment will be described in the order in which a coin encounters it as it travels down the predetermined path or the runway shown in FIG. 1. Oscillator 71 is constructed around a Darlington pair of transistors 91 and 91'. A conventional biasing network, including AC by-pass shown at 92 is provided. A resonant tank circuit is formed by coil 30 and a pair of capacitors 95 and 95'. In the preferred embodiment, capacitors 95 have a value of 0.47 microfarads, and coil 30 presents an inductance of approximately 0.8 millihenries. As is understood by those skilled in the art, the terminal inductance of coil 30 will change in response to the proximity of a metallic coin to the core of coil 30 because, under these circumstances, the coin becomes part of the magnetic circuit.

In the preferred embodiment, the tank circuit has a no coin present quiescent frequency of approximately 18 kilohertz. Furthermore, the components are chosen such that the frequency response characteristics of the oscillator have a relatively low Q factor on the order of 2 or 3.

Capacitors 96 and 97 are relatively large and used to isolate the power supply from the effects of the oscillator circuit.

As a coin traverses the position shown as 30' in FIG. 1C, the magnitude of the output of oscillator circuit 71 begins to decrease. The output of the oscillator circuit is picked off by an emitter follower arrangement with resistor 98 in the emitter circuit of transistor 91' serving as the load. Positive feedback is provided through line 99 back to the junction between capacitors 95.

The output from emitter follower 98 is capacitively coupled through capacitor 110 to a rectifier consisting of diodes 111 and 112. The rectified signal is filtered by an RC filter network, consisting of resistor 115 and capacitor 116, to provide a filtered rectified DC output signal on line 118 which is proportional to the magnitude of the output of the oscillator. Line 118 is connected to the non-inverting input of an operational amplifier 119 configured as an non-inverting the unity gain buffer to provide a buffered output signal on line 120.

Line 120 also serves as the input to A to D converter 72. The signal on line 120 charges a capacitor 121 through a resistor 122, which are connected to each other at point 125. Point 125 is connected to point 126 which is connected to the negated input of a comparator 127 and the collector of transistor switch 128. The base of transistor 128 is connected by line 129 to output pin P10 from microcomputer 60.

The non-inverting input of comparator 127 is connected to point 130, the mid-point of a voltage divider. Thus, point 130 carries a reference voltage used in A to D converter 72.

It will be appreciated by those skilled in the art that the circuitry of A to D converter 72, together with the counter timer within microcomputer 60 form an integrating type analog to digital converter.

When the preferred embodiment is in a state awaiting deposit of coins, the program controlling microcomputer 60 (which is described in detail in connection with FIG. 7 hereinbelow) conducts a conversion through A to D converter 72 approximately every five milliseconds. In the preferred embodiment, the values for capacitor 121 and resistor 122 are chosen so as to have a time constant of approximately three milliseconds.

The conversion cycle begins with output pin P10 being taken high, thus turning on transistor switch 128. This discharges capacitor 121. At virtually the same time, after several machine cycles to get to an instruction to initiate the counter timer of the 8748, a loop is entered wherein the state of pin P0 connected to line 85 is tested. With capacitor 121 discharged, the output from comparator 127 will be high since the reference voltage of point 130 is above the voltage at point 126. Line 129 is taken low, turning off transistor switch 128. Capacitor 121 will then begin to charge at a rate, in volts per unit time, which is determined by the magnitude of the signal on line 120.

When the charge on the capacitor is sufficient to elevate point 126 above the reference voltage at point 130, the output state of comparator 127 toggles, placing a zero on line 185. The next pass through the loop testing the state of this line will detect that the state of the T0 input is changed. Microcmomputer 60 then terminates operation of the counter timer 61 which contains a numerical value proportional to the voltage present on line 120. This is stored for further processing described in connection with FIG. 7.

As will be described hereinbelow in connection with FIG. 7, the above described converstion cycle continues as the coin physically passes coil 30. By the time the coin arrives at a point where its leading edge can occlude photosensor 32, a detection of the minimum value of the voltage present on line 120 which was achieved while the coin was passing by coil 30 has been made and stored.

Next the coin encounters the pair of optical detectors 32 and 35 shown as a part of the LED detectors in block 70. Optodetector 32 is illuminated by LED 132 and optodetector 35 is illuminated by LED 135. As will be apparent from the foregoing description, light emitting diode 132 is disposed on the opposite side of hole 56 shown in FIG. 1C. Similarly, LED 135 is disposed opposite hole 57.

It will be appreciated by those skilled in the art that the combination of diodes 132 and 135 and optical detectors 32 and 35 each form electronic coin sensing means for detecting the presence of a coin. It will further be appreciated that the leading edge of a coin traveling down the predefined path shown in FIG. 1 will sequentially occlude optical detector 32 and 35 and that the leading edge may be detected by transitions from zero to one on lines 86 and 136.

Similarly, the trailing edge of the coin passing by the optical detector may be detected by transitions on these lines from one to zero.

Each of the foregoing transitions marks the beginning or end of one of three distinct time periods used in determining coin diameter as described in greater detail in connection with FIG. 7.

Shortly after optocoupler 35 is uncovered as the trailing edge of the coin passes it, the 8748 calculates the average velocity of the coin, and from one of the stored time periods, calculates a diameter value. Both the value stored for the content and the value stored for the diameter are tested against predetermined ranges of values stored in a look up table within the read only memory within microcomputer 60, and a determination of coin validity is made.

Assuming for the moment that the coin is detected as valid, microcomputer 60 writes a logical one out to pin P17. This places a logical one on line 81 turning on switching transistor 138 which, in turn, activates coin accept solenoid 68. As described hereinabove in connection with FIG. 1, the activation of coin accept solenoid 68 removes lip 47 from the path of the coin headed in the direction of the coin return opening 26, and allows the coin to fall through coin box opening 50 into the coin box.

As the coin falls through opening 50, optical detector 51 is occluded cutting off its source of light LED 141. This produces a transition on line 87 connected to the negated interrupt pin of microcomputer 60. The trailing edge of the pulse generates an interrupt. The interrupt is used to update a total which is maintained for the amount of money deposited, and to enter other appropriate routines for controlling the device in which the validator is used.

If the detector fails to detect a (content, diameter) pair within a valid two-dimensional set of predetermined ranges for these values indicating a valid coin, line 81 will remain in its low state keeping transistor 138 cut off for a sufficient period of time to allow the coin tested to pass over coin box opening 50 and out the coin return slot 26.

In the preferred embodiment, pins P12–P16 are connected to dual in line package single pole switches (dip switches) 69. The combination of closures of switches 69 is used by the preferred embodiment to determine the sum of the value of coins which must have fallen into the coin box for the machine to provide the output sought by the customer. While a fewer or greater number of dip switches may be used to construct embodiments of the invention, in the example shown, five switches are used. There is one switch corresponding to each of the following values: 10¢, 20¢, 40¢, 80¢, $1.60.

The program module within the ROM of microcomputer 60 which determines the total required by the machine to vend its goods or services is determined by the combination of closures. The determination is additive, and thus the value assigned to each switch which is closed is added to produce a total. From inspection of the foregoing list of values it will be readily appreciated that the five switches may be used to require any combination of coins having a total value between 10¢ and $3.10, in ten cent increments, in order to operate the machine in which the preferred embodiment is used.

Assuming for the moment that the necessary total value of coinage has been deposited, microcomputer 60, detecting that the predetermined value has been met or exceeded, sets output pin P24 connected to line 77 high. As is shown in FIG. 3, a selector switch 142 is connected to line 77. When the switch is in the position shown in the drawing, a logical one on line 77 turns on transistor switch 145 activating an exemplary vend solenoid, shown as 146. Thus, with switch 142 in its position shown, the connection of a vend solenoid, for example to control the dispensing of a portion of soft drink, may be made. In the disclosed environment of the preferred embodiment, switch 142 is placed so that its pole is connected to line 147, which is one of the inputs to washer/dryer controls 66.

Upon detection of an adequate amount of money deposited to start the washing machine, a word is written to pins P20–P24 of the port 2 output. As is known to those skilled in the art, this port may be used to provide an output address to an external memory device for fetches of data or instructions from external devices. Thus, the preferred embodiment will write a word out to port 2 indicating that control of the washing machine by microcomputer 60 is to begin. A logical one is written to pin P24 which is connected through line 147 as one input to AND gate 148. The remainder of the word written onto subset 78 of the port 2 connector bus 76 has a control signal written onto line P23 and a three bit word on lines P20–P22, which is one of eight possible control words to the washing machine. The bit state on line P23 will be latched onto output D4 of latches 150. Output D4 is connected to line 151 which controls the tristate output line of a three state buffer 152. The output of buffer 152 is connected to line 155 which may be seen to be electrically identical to line 87 and is thus connected to the interrupt input of microcomputer 60.

The input to buffer 152 is line 67, designated as being from a switch of the washing machine. In the preferred embodiment, the out of balance switch is normally connected to line 67 so that microcomputer 60 may be alerted when the washer is in a spin cycle and the second moment about the spinning agitator has become so great that the washer is vibrating in a manner which may become harmful. Thus, the bit latched onto output D4 of latches 150 removes the high impendance state from line 155 and effectively connects line 67 to the interrupt input of microcomputer 60.

The remaining three bits from subset 78 are latched onto outputs D1–D3 of latches 150, and thus go to a one of eight decoder which is connected to various control switches within the washing machine (shown as block 156). As noted within block 156, it is preferred to use optocouplers to isolate the outputs from latches 150 to the washing machine.

The output of AND gate 148, which appears on line 158, is used to latch the aforementioned data into latches 150. Keeping in mind that switch 142 connects line 177 to line 147, the appearance of a one at output pin P24 indicates that the washing machine should start. This is treated internally by microcomputer 60 with an instruction which is identical to that which writes an address out to an external memory device for an external memory fetch. Thus, the falling edge of the address latch enable signal on line 90 is used to latch the address. Line 90 is connected to a negated input to AND gate 148, and thus a positive transition on line 158 provides a strobe signal so that the output to the washing machine decoder at block 156 is treated as the writing out of an address to an external memory device. With one of the bits dedicated to connecting tristate buffer 152 to line 155, and one of the eight possible states of the three control bits being dedicated to the washing machine being off, there are seven possible commands which may be encoded in the three bit control word. It will be appreciated by those skilled in the art that seven possible command states are clearly adequate to control most commercial washing machines.

As noted hereinabove, the present invention may be used to control dryers and many other devices for which a control algorithm may be reduced to coded instructions resident in the read only memory of microcomputer 60. As shown in FIG. 3, the present invention may be used to operate a more conventional vend solenoid, such as solenoid 146.

Figure 4:
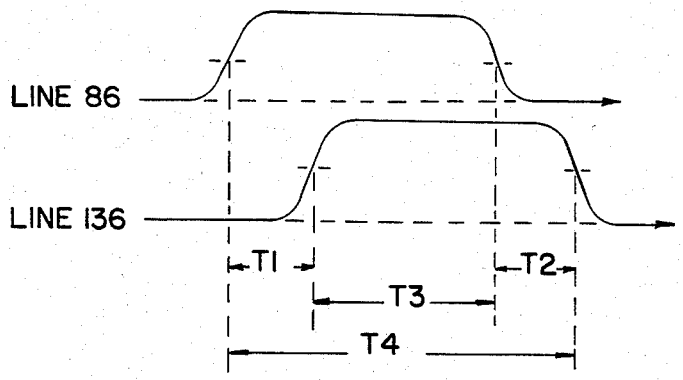
FIG. 4 is a timing diagram of the three time periods measured by the preferred embodiment in connection with the detection of the velocity of the coin.

The operation of the improved diameter detector will now be explained in detail. FIG. 4 shows a timing diagram representing the states of lines 86 and 136 shown in FIG. 3. Thus, a logical one represented on the timing diagram of FIG. 4 corresponds to a coin covering the optical detector.

Figure 5A:
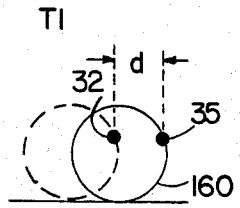
FIG. 5, consisting of FIGS. 5A–5D, show the geometric arrangements of a coin passing the coin sensors in the preferred embodiment.
Figure 5B:
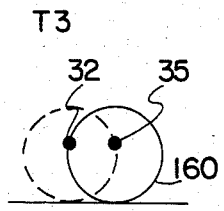
Figure 5C:
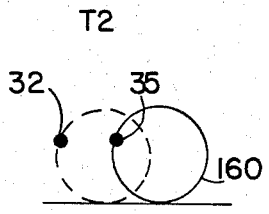

In the preferred embodiment of the present invention, United States nickels, dimes, quarters, and the much maligned Susan B. Anthony dollar, are defined as valid coins. It is preferred to have distance d shown in FIG. 1C be such that any one of the defined valid coins will, at one point as it travels down the runway, occlude both optical detectors. However, it will become apparent from the following description that these detectors may be spaced apart in a manner which allows a valid coin to reside between the optocouplers, occluding neither, and still construct an embodiment of the present invention. Three distinct time periods are determined by the apparatus of the present invention as the coin passes the optodetectors. These may be appreciated by viewing FIG. 5 in conjunction with FIG. 4. In FIGS. 5A–5C, an exemplary coin 160 is shown as passing optodetectors 32 and 35.

In each of FIGS. 5A–5B, the coin shown in phantom represents the beginning of one of the distinct time periods and the coin shown in its asserted form shows the event which marks the end of the time period. FIG. 5A represents time period T1 shown in FIG. 4. As may be seen by the coin in phantom, T1 begins when the leading edge of the coin is first detected by occlusion of optocoupler 32. Time period T1 ends when the leading edge is detected by occlusion of the second optocoupler.

FIG. 5B shows time period T3. Naturally, T3 begins as T1 ends and thus, the coin in phantom in FIG. 5B is the same as the asserted coin in FIG. 5A. Time period T3 ends when the trailing edge of coin 160 is detected by the uncovering of optodetector 32. FIG. 5C likewise shows time period T2 which begins at the state described immediately hereinabove, and ends when the trailing edge of coin 160 uncovers optocoupler 35. As shown in FIG. 4, the total of time periods T1–T3 has been indicated as period T4.

Figure 5D:
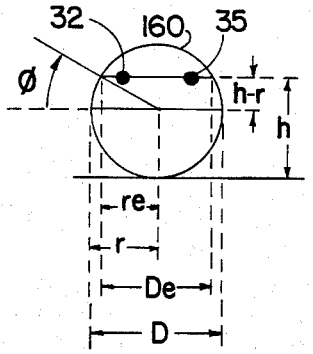

Turning next to FIG. 5D, a brief demonstration of the fact that the above-recited coins of various diameters can have their true diameter unambiguously determined by the arrangement used in the present invention, wherein a pair of optodetectors are disposed a predetermined height h, above the coin's runway is shown. The angle $\phi$ is defined as the angle between the center of the coin and a diameter of the coin parallel to the runway. r is the coin's radius with $r_e$ being defined as "an effective radius" or one-half of the chord length $D_e$. This notation for the chord length was chosen to suggest an "effective diameter". D is the true diameter of the coin. As shown in FIG. 5D, the expression h-r is an expression which varies with the coin in question, and is a measure of the height of the optodetectors above the geometric center of the coin.

Without further detailed explanation, it will be apparent from inspection of FIG. 5 and the following formulas that the true diameter D may be unambiguously determined from knowing the chord length $D_e$. This is demonstrated because, as will be apparent, the diameter value measured by the preferred embodiment actually measures the length of the chord of the coin which passes over optodetectors 32 and 35.

$$\text{SIN}\ \phi = \frac{h - r}{r}$$

$$\text{COS}\ \phi = \frac{r_e}{r}$$

$$\text{TAN}\ \phi = \frac{\text{SIN}\ \phi}{\text{COS}\ \phi} = \frac{\frac{h - r}{r}}{\frac{r_e}{r}} = \frac{h - r}{r_e}$$

$$r = \frac{r_e^2 + h^2}{2h}$$

$$D = \frac{0.25\ D_e^2 + h^2}{h}$$

Figure 6:
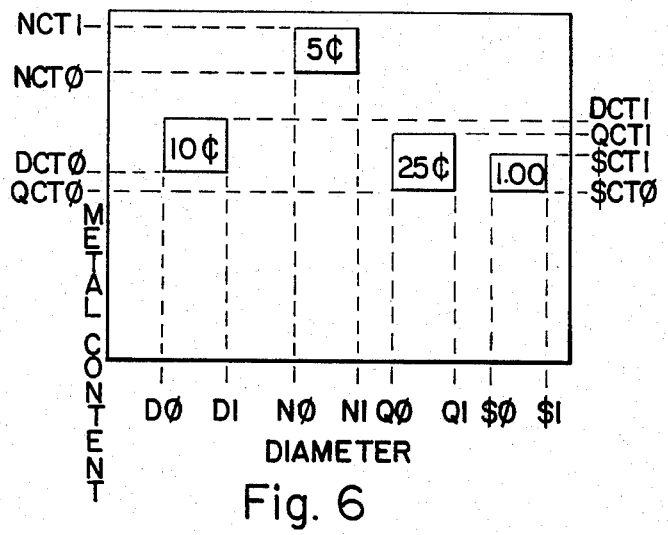
FIG. 6 is a graphical representation of the predetermined ranges of valid diameter values and valid content values used in the preferred embodiment.

Turning next to FIG. 6, a graphic representation of the predetermined ranges of content values and diameter values is shown. FIG. 6 represents the range of values in conventional Cartesian coordinates in the first quadrant so that the metal content signal on the ordinant increases as one moves upward, and diameter values on the abscissa increase one moves from left to right. The ranges of content values are ranges of deviation from the quiescent value of the magnitude of the output from oscillator circuit 71. The quiescent value is the no coin value.

Since the contents of United States dimes, quarters and dollar coins are quite similar, one expects the overlap in predetermined ranges of content values for these coins which is shown on FIG. 6.

Thus it will be seen, by way of example, that the range of diameter values between that marked DØ to D1 is a predetermined range of diameter values for the U.S. dime. Similarly, $CT1 and $CTØ define the predetermined range of content values for the Susan B. Anthony dollar coin. It should be appreciated that the values for the limits shown on FIG. 6 are stored in the read only memory of microcomputer 60 in a look up table.

Figure 7B:
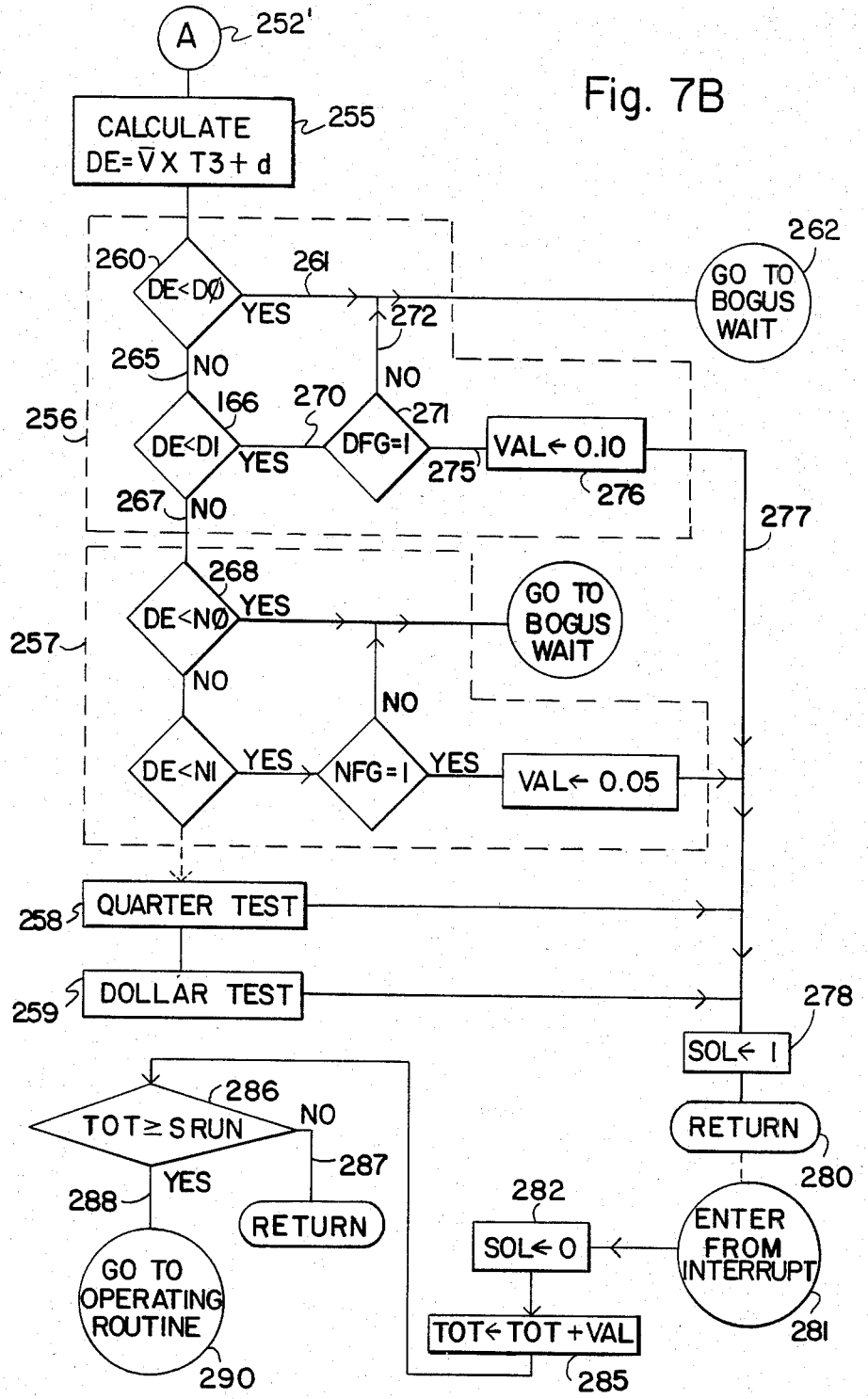
FIG. 7, consisting of FIGS. 7A and 7B is a flow chart showing the logic of the program controlling the microcomputer of the preferred embodiment.

Turning next to FIG. 7, consisting of FIGS. 7A and 7B, the operation of the code controlling microcomputer 60 will now be explained. The flow chart of FIG. 7 diagrammatically shows the code for the following operations:

(a) determining the content value for the coin;
(b) testing to see if the content value is within one of the predetermined content values represented on FIG. 6;
(c) acquiring the three distinct time periods T1, T2, and T3 represented in FIG. 4;
(d) calculating the average velocity of the coin;
(e) calculating the chord length, or effective diameter;
(f) testing to see if the diameter values within one of the predetermined ranges;
(g) activating the coin drop solenoid allowing a coin to drop through opening 50; and
(h) testing to see if the total amount deposited has reached a predetermined value in order to cause the machine in which the validator is used to vend its goods or services.

Assembly language coding for the 8748 use in the preferred embodiment is well known to those skilled in the art and, from the flow chart of FIG. 7, persons skilled in the art will easily be able to prepare appropriate code for the ROM of microcomputer 60. Likewise, the use of other types of one chip microcomputers and microprocessor chip sets to construct embodiments of the present invention will be apparent to those skilled in the art in light of this disclosure.

The program is entered at step 175 (FIG. 7A). The notation at step 175 indicates that the program generates an internal interrupt every five milliseconds to test for the presence of a coin. So that the significance of the variable values shown in FIG. 7 may be appreciated, the following table 1 is presented which defines the type (Boolean or real, where real can include integer values) and the significance of each of the variables used in FIG. 7.

TABLE 1

Boolean

F1—Flag that is set when content test shows decrease. It is tested on each conversion. Two conversions in a row with decreasing values implies coin is in field of coil.

F2—Flag used to find saddle point for contents test. It is set when the COIN flag is set and most recent conversion is greater than, or equal to, previous value.

COIN—flag set when two successive conversions show decrease.

$FG, QFG, DFG, NFG—are "dollar flag", "quarter flag", etc. Each is set after contents test if test shows result within window for each respective coin.

PP1—is the pin P11 of the microprocessor Port one

PTO—"Pin T0" one of the testable pins on the processor used for the A-D conversion.

PTI—"Pin T1", the other testable pin.

SOL—"solenoid" output set equal to 1 when valid coin detected. Drives solenoid which lets coin drop into box.

Real

CCNT—"Conversion Count" The count in an internal counter used in the A-D conversions.

LSTCNT—"Last Count" —value of CCNT from previous conversion.

MAX—"Maximum" largest value (recent) of CCNT. Used to store "no coin" value.

CONT—"Content" numerical value of MAX-MIN, indicates metal contents.

$CTØ, $CT1, QCTØ, QCT1, etc. are the min and max limits of the contents for the various denominations. Define the content limits of the ranges.

NØ, N1, DØ, D1, QØ, Q1, $Ø, $1, are the min and max (respectively) limits for diameter. Define limits for diameter of the window.

T1, T2, T3, time periods from counter/timer 61 as shown in FIG. 2.

V—Average velocity of coin moving past LEDs.

DE—"Effective diameter" is the measured "diameter" of the coin as it passed the LEDs. It is actually a measure of the chord of the coin which passed over the diodes.

TOTAL—total value of coins deposited.

$RUN—amount necessary to turn on washer.

The first block entered by the code is labeled 176. This block controls analog to digital converter 72 (FIG. 3) and detects the presence of a coin near coil 30 by detecting a drop in the digitized value of the magnitude of the output signal of oscillator 71. Once this is detected, program block 176 acquires a value for the maximum excursion in the output of the oscillator and stores that as a content value. Step 177 sets pin 10 low, and then high, which momentarily turns on transistor switch 128 discharging capacitor 121 (FIG. 3).

After this, steps 178 and 179 form a loop for performing the analog to digital conversion. Variable CCNT, the conversion count, is incremented until pin T0 connected to line 85 goes low indicating that the voltage at point 125 has exceeded the reference voltage at point 130. After this occurs, the yes branch 180 is taken from step 179 to decisional step 181.

Step 181 compares the conversion count to the last count variable shown as LSTCNT in FIG. 7. When there is no change in this count, as when no coin is present, no branch 185 is taken indicating that the most recent conversion count was greater than or equal to the previous conversion count. From this point, decisional step 186 tests the flag COIN to see if it has previously been set. In the event that it has not, no branch 187 is taken, flag F1 is cleared at step 188, and the variable MAX is replaced by the most recent conversion count at step 189.

From step 189, branch 190 leads to step 191 wherein the last count variable is replaced by the present count, the present count register is cleared at 192 and a return to the controlling portion of the program is made at 195, until the next internal interrupt is generated causing the program to reenter step 175. The above-described sequence of steps is executed repetitively when no coin is present.

Assuming that a coin is coming into proximity with coil 30, the value of the conversion count CCNT will begin to drop. When this first occurs, yes branch 196 will be taken from conditional step 191. A flag called F2 is cleared at step 197, and a flag called F1 is tested at 198. Keeping in mind that F1 was always cleared at step 188 prior to the appearance of the coin, on the first pass through the program as the output of the oscillator is falling, no branch 199 will be taken to step 200 which sets flag F1 and updates LSTCNT and CCNT at steps 191, 192 and 195.

Again assuming the presence of the coin, the next conversion count will be less than the previous one and, once again, branch 196 will be taken. However, at conditional step 198 on the second pass through this portion of the program, yes branch 210 will be taken causing the flag COIN to be set at step 211. From this point, the update sequence of steps is executed and conversion counts are continually made and compared.

In examining the portion of the control program described so far, the following should be apparent. Through the use of flag F1, as tested at step 198 and set at step 200, the control code assures that the flag COIN does not become set at step 211 until two successive conversion counts have been less than their predecessors. This assures that if, from time to time, there is a change in the least significant bit of the conversion count which may be caused by temperature variations of the components, or quantitization error, the program will not assume that a coin is present. Note that if one such change in the least significant bit occurs as an increase, the detection that the COIN flag has not been set at step 186 prevents the program from treating the increases as if a saddle point had been reached. The clearing of flag F1 at step 188 through this portion of the code assures that a random one bit decrease in the count is not treated as an indication that a coin is present. Under these circumstances, it is assumed that one count is less than its predecessor, sending the program through the branch 196 from step 181. Under these circumstances, flag F1 is set at step 200 and the program awaits the next count. When the next count is generated, it is assumed that it is greater than or equal to the previous count since the change was considered somewhat random in nature. Under these circumstances, no branch 185 is taken and, since the COIN flag has not been set, flag F1 is cleared at step 188.

Returning to the example of a coin being present, the steps on the righthand side of block 176 will continue to be executed until a saddle point in the time varying value of the output of the oscillator is reached. When this occurs, no branch 185 will be taken from step 181 because the present conversion count is greater than or equal to its previous value. Under the circumstances described, the test of the COIN flag at step 186 will cause yes branch 212 to be taken. As an added precaution, flag F2 is tested at step 215. Flag F2 is used to assure the legitimate saddle point has been reached so that the device will not respond to a small quantitization error as the output approaches the saddle point where the slope becomes very small. On the first pass through, no branch 216 will be taken and flag F2 will be set at step 217. From this point at step 218 the value of the variable MIN is loaded with the present conversion count. From this step, branch 190 returns to the update steps and awaits the next conversion.

Since the example assumes valid coin is present, the next conversion count will either be equal to or greater than the previous one since the output of the oscillator will either be at a flat portion of its characteristic near the saddle point, or beginning to rise Thus, branches 185 and 212 are taken to the test of flag F2 at step 215. The detection that flag F2 has been set indicates that a valid saddle point has been reached since two successive conversion counts were equal to or greater than their predecessors, and yes branch 219 is taken.

The COIN flag is cleared at step 220 and the program exits block 176 along line 221. The completion of block 176 via exiting on branch 221 indicates that valid values for the maximum and minimum magnitudes of the oscillator output signal have been acquired as variables MAX and MIN. Note that it is only the magnitude of the oscillator output which is acquired by the preferred embodiment. The circuitry of the preferred embodiment is not directly sensitive to frequency variations in the oscillator output.

Branch 221 causes the program to enter block 225 wherein microcomputer 60 tests to determine if the content value was within a predetermined range of content values. The first step is 226 wherein the variable CONT is replaced by the difference between the maximum and minimum values of the oscillator output. Thus variable CONT is a content value acquired by microcomputer 60 in conjunction with oscillator 71 and A to D converter 72 (FIG. 3).

The logic of the test steps executed within block 225 can be appreciated by reference to FIG. 6. Step 227 first tests the content value to determine if it is greater than a minimum value for the dollar coin, or more precisely, the minimum acceptable value minus the value represented by the least significant bit.

If it is not, no branch 228 is taken to step 229 marked "go to bogus wait". This is a routine (not shown) which causes the machine to return to the control program awaiting the next detection of a coin by block 176. It will be apparent from observation of FIG. 6 that value $CTØ is the minimum valid value for any content signal. Thus, the decision that the coin is bogus can be based solely on the fact that the content value did not even reach this minimum value.

If the yes branch is taken from step 227, a sequence of other tests are made whereby the particular range of values for the content variable are tested and appropriate flags indicating which predetermined ranges of content values are satisfied by the particular acquired content value, are set. Step by step detail of these tests will not be given because reading table 1 and examining FIG. 6 in connection with block 225 will be self explanatory to those skilled in the art. However, a few salient features will be noted. First, since the predetermined ranges of content values for the dime, quarter and dollar coin all overlap, it is possible that all three flags will be set when the program exits at 232. One of the coin content flags is set for every coin which could be represented by the acquired content value. If the yes branch is taken from step 227 and the content value is not less than the maximum value for a quarter (QCT1), then step 230 is used to test if the content value is less than the maximum value for the dime (DCT1). Note from FIG. 6 that DCT1 is the maximum allowable content value for any "silver" coin.

If the no branch is taken from step 230, a pair of steps testing to see if the content value is within the range defined for the nickel coin are executed. If the acquired value fails this test, program control goes to the bogus wait state at step 231. If the acquired content value is within the predetermined range for the nickel coin, the nickel flag is set and the program continues along branch 232. Thus, the content value is acquired as the program enters block 235. When the program exits block 225 at branch 232, all the coin content flags representing possible values of the coin, based on its content, are set.

At step 136, variables T1, T2 and T3 are cleared. Once the time period value has been cleared at step 236, a loop around test step 237 is entered. Branch 238 will continually be taken until the leading edge of the coin passes optodetector 32 indicating the beginning of time period T1 (see FIG. 4). When this occurs, yes branch 239 is taken and another loop, which includes the step of incrementing the count for T1 at step 240 and testing to see if optodetector 35 has been occluded at step 241, is entered.

Branch 242 is taken and the count for T1 is continuously incremented until the change of state at pin P11 of the processor is detected causing this loop to be exited via yes branch 245. As will be appreciated by those skilled in the art, the incrementing illustrated within the loops of block 235 is physically accomplished by incrementing of counter/timer 61 shown in FIG. 2 in a manner that is known to those skilled in the art.

The taking of branch 245 indicates that time period T1 has been acquired and a similar loop consisting of steps 246 and 247 is entered to acquire time period T3 as shown in FIG. 4. When this is accomplished, yet another loop consisting of steps 248 and 249 is entered to acquire time period T2. When the yes branch 250 is taken from step 249, this indicates that the trailing edge of the coin has been detected by optodetector 35 as it became uncovered.

The microcomputer then calculates the average velocity of the coin by executing a sequence of steps, all of which are represented by the formula shown at block 251.

It will be appreciated from elementary physics that the expression shown for average velocity (V) is a formula which provides the average velocity of a coin traveling down the runway at either a constant speed, or under constant acceleration (which will normally be the case) where the time periods T1–T3 are as shown in FIG. 4, and the variable d is the distance between the optoisolators as shown in FIG. 5A. It will be appreciated that this expression gives the average velocity of the coin when its center is between optodetector 32 and optodetector 35. From step 251 the control program goes to a connector referenced as 252. Connector 252 references entry point 252' on FIG. 7B. The next step performed by the program is that shown at step 255 calculating the diameter which is the product of time period T3 times the average velocity, plus the distance between the optosensors.

From the foregoing it will be appreciated that the chord length of the coin, DE, is calculated using the true average velocity of the coin as a midpoint of the chord laying on the line connecting optoisolators 32 and 35 coincides with the midpoint of the line connecting them. Thus, it will be further appreciated that the present invention accurately calculates the effective diameter (the chord length) which, within limits, is insensitive to the actual velocity. The limits referred to are an upper limit on velocity which is determined by the resolution of the timing loops shown within block 235. Thus, this limit is directly related to the period of the clock signal clocking counter timer 61 (FIG. 2). The lower limit on velocity is determined by the above referenced clock period and the scale of counter/timer 61. The important point is that the angle at which the runway is placed in order for the diameter measuring apparatus of the present invention to respond, becomes non-critical since it does not assume any particular velocity of a given valid coin as it travels down the runway.

Furthermore, it will be appreciated that this is accomplished without the use of complex array of LEDs and optodetectors, but with a system which uses only a pair of electronic coin sensors.

Once the diameter value (the chord length) has been acquired, microcomputer 60 then performs a series of four identical (except for the ranges being compared to the variable DE) tests to determine if the diameter value DE falls within one of the predetermined ranges of diameter values shown on FIG. 6. These tests are in ascending order of valid coin diameter and are shown as blocks 256 through 259. Since these are conceptually identical, only the dime test will be described.

The first step is the test performed at step 260 to determine if the diameter value is less than the minimum diameter for the dime. If the answer is yes, branch 261 is taken to go to bogus weight state exit 262. FIG. 6 clearly shows that if the diameter detected is less than the minimum diameter of the dime, the diameter is clearly not within the ranges of diameters for valid coins. If no branch 265 is taken from step 260, the upper range for the dime diameter is tested at step 266. If this test is also negative, the dime test is exited via branch 267 into the nickel test for diameter and, subsequently, to other tests if these fail.

Note that the first step of each subsequent test which corresponds to test 260 exits to the bogus wait state if the first test is true. This is because to arrive at the first test for a coin diameter test, one must first have determined that the diameter was greater than the maximum allowable diameter for the next smaller coin. Thus, a determination that the diameter value is greater than value D1 at step 266 and a subsequent negative response to step 268 in the nickel test, shows that the detected diameter value falls between the valid range of dime values and the valid range of nickel values. Each of these tests must be performed, as can be seen from FIG. 6, because the valid predetermined ranges of diameter values are mutually exclusive, that is, they do not overlap in the fashion that the content values ranges do.

Returning to the example for the dime, assume for the moment that test 266 is positive and thus branch 270 is taken. It will be appreciated that branching of the routine to branch 270 indicates that the diameter value determined by the apparatus shown in FIG. 3 is within the predetermined range of diameter values for the dime coin, DØ, D1. Once this occurs, the next test is at step 271 to determine if the flag for the dime has been set based on the contents test. If the dime flat has not been set, no branch 272 is taken which goes to the bogus wait exit 262. Thus it will appreciated under these circumstances, that the detected diameter was in the range of diameters for a dime coin, however, the content was not (because dime flag DFG was not set), and thus the conclusion is that the coin is bogus.

If the dime flag had been set, branch 275 is taken indicating that the coin has both a diameter and a content value which fall within the predetermined ranges for the dime coin. Thus, the apparatus concludes that the coin is indeed a dime. This branch leads to step 276 in which a value variable (VAL) is loaded with a value of 0.10. From step 276, branch 277, which is the common branch for all successful exits from the coin diameter tests is taken to step 278 wherein a solenoid output variable SOL is set to the value one. Microcomputer 60 will then write a logical one to pin P17 which turns on transistor switch 183 activating coin or accept solenoid 68 (FIG. 3).

From this point, the system returns to its supervisory program at step 280. The next event of concern will be understood by referencing FIG. 3. The coin will travel down the runway until it arrives at opening 50 (FIG. 1) where the coin drops into the coin box. This event occludes the optical path between LED 141 and optodetector 51 causing a transistion on line 87. Line 87 is connected to the negated interrupt input of microcomputer 60 and thus an interrupt routine is initiated which, as shown at step 281, returns to step 282 in which the variable SOL is cleared. This will terminate operation of the coin accept solenoid.

Next, step 285 is performed in which a total value variable, shown as TOT, is incremented by the value of the variable VAL. From this point, a test is made at step 286 to determine if the total variable was greater than or equal to a variable shown as $RUN which, as shown in table 1, is a vend value: the amount necessary to turn on the vending machine. Naturally, the value of variable $RUN is derived from the state of switches 69 shown in FIG. 3. If no branch 287 is taken from this step, the routine returns to its supervisory program from which it will continue to generate internal interrupts every five milliseconds to test for the presence of another coin. If yes branch 288 is taken, this indicates that a sufficient amount of money has been deposited and accepted, and the apparatus proceeds to an operating routine, which is shown at 290 in FIG. 7B, to operate the machine in which the validator is resident. Examples of the operating routine were described above in connection with FIG. 3 which include operation of a vend solenoid 146 and writing out of control signals into latches 150.

From the foregoing description, it will be appreciated by those skilled in the art that the present invention accomplishes the objects set forth above. It will further be appreciated that, in view of the disclosure herein, other embodiments of the present invention will suggest themselves to those skilled in the art, and thus the scope of the present invention is to be limited only by the claims below.

I claim:

1. In an electronic coin validator of the type including a content measuring apparatus for measuring the metal content of a coin as it travels along a predefined path, an improved diameter measuring apparatus comprising in combination:

a first electronic coin sensor located along said path;

a second electronic coin sensor, spaced apart a predetermined distance from said first electronic coin sensor, along said path;

timing means connected to said first and second electronic coin sensor for measuring, and storing in a memory, three distinct time intervals between a first event corresponding to the leading edge of said coin being sensed by said first electronic coin sensor and a second event corresponding to the trailing edge of said coin being sensed by said second electronic coin sensor;

calculating means connected to said memory for providing a calculated average velocity of said coin as it passed said first and second electronic coin sensors, and for subsequently calculating an effective diameter of said coin in response to said calculated average velocity and one of said three distinct time intervals;

storage means for storing a plurality of predetermined ranges of diameter values;

comparison means connected to said calculating means and said storage means for comparing said effective diameter to said plurality of predetermined ranges of diameter values and for providing a valid diameter output signal in response to detection of said effective diameter being within one of said plurality of predetermined ranges of diameter values.

2. The improvement as recited in claim 1 wherein said first and second electronic coin sensors are located the same distance above said path and said predetermined distance is less than a cord of a smallest coin of interest defined by a line passing through said first and second electronic coin sensors when said smallest coin of interest is resting on said path with the geometric center of said coin being located between said first and second electronic coin sensors.

3. The improvement of claim 1 wherein said first and second electronic coin sensors each comprise a light-emitting diode and an optical sensor, spaced apart transverse to said path; and said timing means, said calculating means and said comparison means comprise a microcomputer.

4. The improvement of claim 1 wherein said content measuring apparatus includes an oscillator including a coil disposed near said path for providing an oscillator output signal characterized by an output value which varies in response to a metallic coin traveling along said path;

means for providing a content output signal in response to detection of a maximum deviation of the magnitude of said oscillator output signal with respect to a quiescent magnitude, and further comprising content comparison means for providing a content valid output signal in response to detection of said content output signal being within one of a plurality of predetermined ranges of content values.

5. The improvement of claim 4 further comprising means for providing a valid coin output signal in response to detection of both said valid diameter output signal and said valid content output signal.

6. The improvement of claim 5 further comprising control means for providing control signals for a laundry machine in response to said valid coin output signal.

7. The improvement of claim 5 further comprising totalizer means responsive to successive occurrences of both said valid diameter output signal and said valid content output signal, for providing a total value signal corresponding to a summation of coin values for which said valid diamter and valid content signals were provided;

means for providing a vend output signal in response to said total value signal equaling or exceeding a predetermined vend value.

* * * * *